US008979488B2

(12) United States Patent
Park et al.

(10) Patent No.: US 8,979,488 B2
(45) Date of Patent: Mar. 17, 2015

(54) CAST TURBINE CASING AND NOZZLE DIAPHRAGM PREFORMS

(75) Inventors: Junyoung Park, Greer, SC (US); George Albert Goller, Greenville, SC (US); Brian Victor Moore, Niskayuna, NY (US); Jason Robert Parolini, Greer, SC (US)

(73) Assignee: General Electric Company, Schenectady, NY (US)

( * ) Notice: Subject to any disclaimer, the term of this patent is extended or adjusted under 35 U.S.C. 154(b) by 967 days.

(21) Appl. No.: 13/069,471

(22) Filed: Mar. 23, 2011

(65) Prior Publication Data

US 2012/0243981 A1 Sep. 27, 2012

(51) Int. Cl.

| | |
|---|---|
| ***F04D 29/02*** | (2006.01) |
| ***F01D 25/24*** | (2006.01) |
| ***F01D 9/02*** | (2006.01) |

(52) U.S. Cl.

CPC *F01D 25/24* (2013.01); *F01D 9/02* (2013.01); *F05B 2280/1011* (2013.01); *F05D 2230/21* (2013.01); *F05D 2300/111* (2013.01)

USPC ..... 415/200

(58) Field of Classification Search

USPC ..... 415/108, 200, 214.1, 220, DIG. 915; 164/112, 332, 334, 369; 29/526.2, 29/526.4, 527.5, 527.6

See application file for complete search history.

(56) References Cited

U.S. PATENT DOCUMENTS

| | | | | | |
|---|---|---|---|---|---|
| 3,741,680 | A | * | 6/1973 | Killmann et al. | 415/214.1 |
| 4,137,006 | A | * | 1/1979 | Becker | 415/201 |
| 4,208,777 | A | * | 6/1980 | Walsh et al. | 29/418 |
| 4,305,192 | A | * | 12/1981 | Becker | 29/888.02 |
| 4,520,858 | A | | 6/1985 | Ryntz, Jr. et al. | |
| 5,000,244 | A | | 3/1991 | Osborne | |
| 5,031,685 | A | | 7/1991 | VanRens | |
| 5,054,537 | A | | 10/1991 | VanRens | |
| 5,109,668 | A | | 5/1992 | Lindstedt | |
| 5,609,698 | A | * | 3/1997 | Kelly et al. | 148/671 |
| 5,846,050 | A | * | 12/1998 | Schilling | 415/135 |
| 6,506,018 | B1 | * | 1/2003 | Brennan | 415/214.1 |
| 6,845,816 | B2 | * | 1/2005 | Kirk et al. | 166/241.6 |
| 7,198,465 | B1 | * | 4/2007 | Ichiryu | 415/214.1 |
| 2009/0185896 | A1 | * | 7/2009 | Kizuka et al. | 415/115 |
| 2010/0080698 | A1 | * | 4/2010 | Flanagan et al. | 415/213.1 |
| 2010/0322813 | A1 | | 12/2010 | Bouse et al. | |

OTHER PUBLICATIONS

C.M. Ecob, "A Review of Common Metallurgical Defects in Ductile Cast Iron", Causes and Cures, http://www.elkem.no/dav/dfa48df95b.pdf.

* cited by examiner

*Primary Examiner* — Edward Look
*Assistant Examiner* — Aaron R Eastman
(74) *Attorney, Agent, or Firm* — Cantor Colburn LLP

(57) ABSTRACT

Various turbine component preforms are disclosed having near-net shape features. In one embodiment, a turbine casing preform is disclosed. The turbine casing preform includes an as-cast body comprising a partially cylindrical wall section of a turbine casing, the wall section having an inner surface and an outer surface. The turbine casing preform also includes a circumferentially-extending vane slot formed in the wall section on the inner surface. In another embodiment, a turbine nozzle diaphragm preform is disclosed. The turbine nozzle diaphragm preform includes an as-cast body comprising a partially-cylindrical wall section of a turbine nozzle diaphragm having an inner surface and an outer surface. The turbine nozzle diaphragm preform also includes an as-cast, circumferentially-extending seal member projecting from one of the outer surface or inner surface.

20 Claims, 6 Drawing Sheets

FIG. 7

| Si | C | CE | Si | C | CE |
|---|---|---|---|---|---|
| 2.0 | 3.71 | 4.38 | 3.1 | 3.40 | 4.43 |
| 2.1 | 3.68 | 4.38 | 3.2 | 3.37 | 4.44 |
| 2.2 | 3.65 | 4.38 | 3.3 | 3.34 | 4.44 |
| 2.3 | 3.63 | 4.39 | 3.4 | 3.32 | 4.45 |
| 2.4 | 3.59 | 4.39 | 3.5 | 3.29 | 4.45 |
| 2.5 | 3.57 | 4.40 | 3.6 | 3.26 | 4.46 |
| 2.6 | 3.54 | 4.40 | 3.7 | 3.23 | 4.47 |
| 2.7 | 3.51 | 4.41 | 3.8 | 3.21 | 4.47 |
| 2.8 | 3.48 | 4.41 | 3.9 | 3.18 | 4.48 |
| 2.9 | 3.45 | 4.42 | 4.0 | 3.15 | 4.49 |
| 3.0 | 3.42 | 4.42 | | | |

FIG. 8

| Si | C | CE | Si | C | CE |
|---|---|---|---|---|---|
| 1.5 | 3.16 | 3.66 | 2.6 | 2.83 | 3.70 |
| 1.6 | 3.13 | 3.66 | 2.7 | 2.80 | 3.70 |
| 1.7 | 3.10 | 3.67 | 2.8 | 2.77 | 3.70 |
| 1.8 | 3.07 | 3.67 | 2.9 | 2.74 | 3.71 |
| 1.9 | 3.04 | 3.67 | 3.0 | 2.71 | 3.71 |
| 2.0 | 3.01 | 3.68 | | | |
| 2.1 | 2.98 | 3.68 | | | |
| 2.2 | 2.95 | 3.68 | | | |
| 2.3 | 2.92 | 3.69 | | | |
| 2.4 | 2.89 | 3.69 | | | |
| 2.5 | 2.86 | 3.69 | | | |

CAST TURBINE CASING AND NOZZLE DIAPHRAGM PREFORMS

BACKGROUND OF THE INVENTION

The subject matter disclosed herein relates to turbine casings and nozzle diaphragms for industrial gas and wind turbines, and more particularly, to cast iron near-net shape turbine casing and nozzle diaphragm preforms.

Turbine casings for operating at elevated temperatures have generally been restricted to alloy steel castings or fabrications. Traditional ferritic ductile irons are less costly than alloy steels, but typically have had an inadequate combination of properties, thereby precluding their use in advanced gas turbine compressor discharge and turbine shell casings and other components, such as nozzle diaphragms. One of the limiting aspects has been related to the fact that these components have been made as sand castings. Finish machined conventional sand castings used for turbine components, such as casings and nozzle diaphragms, must have complex features added to them by machining. Due to the nature of conventional sand casting processes, which are currently used to cast the cast iron casings and nozzle diaphragms used in gas turbines and wind turbines, these features, including vane slots, bolt holes and various seals, depend on extensive machining upon completion of the casting process. It is not uncommon to find that the machining processes costs considerably more than the casting. However, from a metallurgical perspective, increasing the casting size to provide machining allowances significantly decreases the structural integrity of the cast parts. Larger castings with more machining allowances take longer to solidify and cool, which can cause degenerate graphite formation in ductile iron castings. Further, the larger castings typically require more risers or reservoirs for the molten metal to increase castability. However, the addition of more risers also tends to increase the likelihood of producing degenerate forms of graphite, which are known to reduce the elongation and fatigue properties resulting in reduced operating lifetimes. Also, desirable fine grain structures are typically found adjacent to as-cast surfaces. However, current sand cast iron components used in gas and wind turbines are heavily machined removing the desirable fine grain structures and frequently exposing undesirable internal microstructural features and volumetric defects, such as internal microporosity and degenerate graphite forms. Therefore, it is desirable to provide cast iron turbine components that significantly reduce or eliminate machining operations, provide desirable fine grain microstructures and avoid the creation and exposure of undesirable internal microstructural features.

BRIEF DESCRIPTION OF THE INVENTION

According to one aspect of the invention, a turbine casing preform is disclosed. The turbine casing preform includes an as-cast body comprising a partially cylindrical wall section of a turbine casing, the wall section having an inner surface and an outer surface. The turbine casing preform also includes a circumferentially-extending vane slot formed in the wall section on the inner surface.

According to another aspect of the invention, a turbine nozzle diaphragm preform is disclosed. The turbine nozzle diaphragm preform includes an as-cast body comprising a partially-cylindrical wall section of a turbine nozzle diaphragm having an inner surface and an outer surface. The turbine nozzle diaphragm preform also includes an as-cast, circumferentially-extending seal member projecting from one of the outer surface or inner surface.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 7 is a table illustrating exemplary ferritic/pearlitic ductile iron compositions as disclosed herein; and FIG. 8 is a table illustrating exemplary austenitic ductile iron compositions as disclosed herein;

Figure 1:
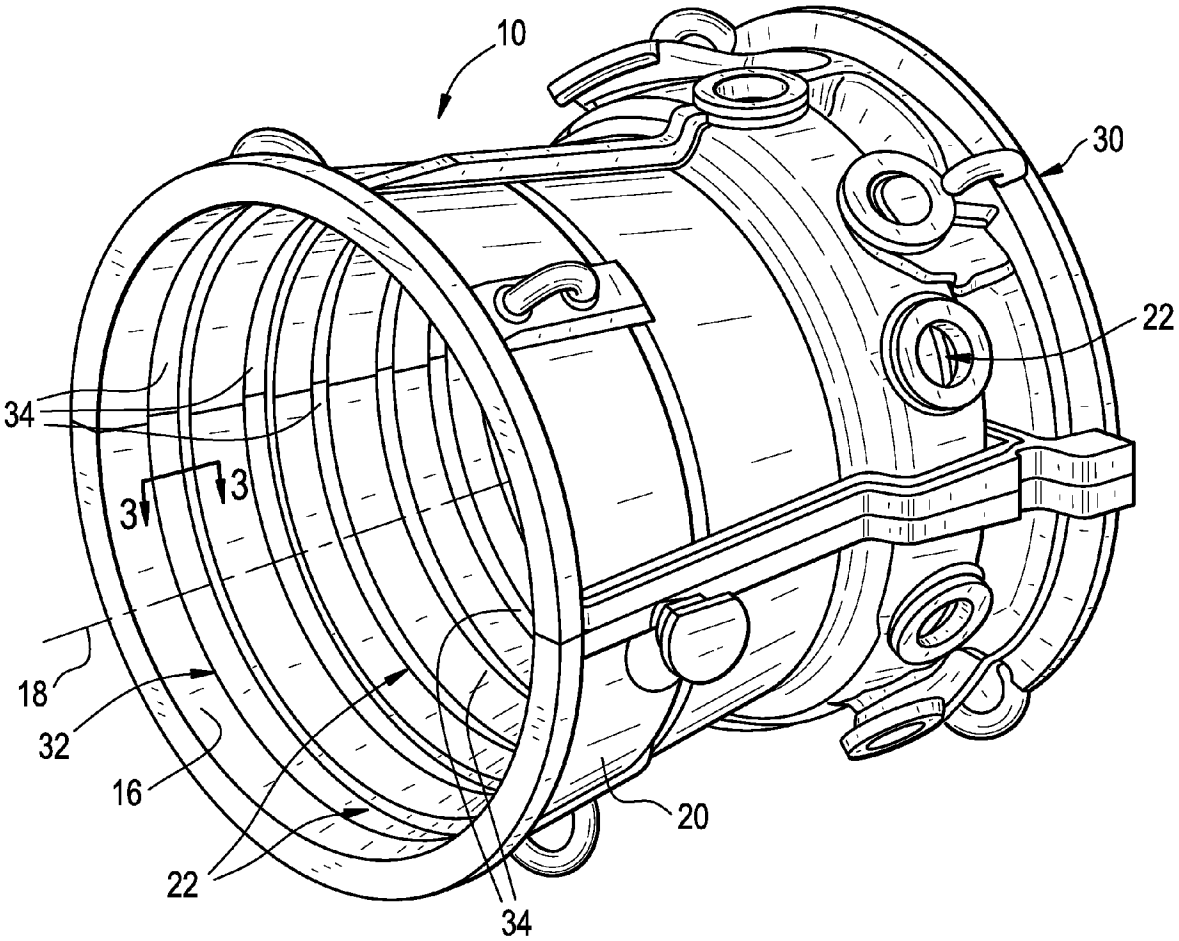
FIG. 1 is a perspective view of an exemplary embodiment of a turbine component preform in the form of a turbine casing preform as disclosed herein.

The detailed description explains embodiments of the invention, together with advantages and features, by way of example with reference to the drawings.

DETAILED DESCRIPTION OF THE INVENTION

Referring to FIGS. 1-8, an as-cast turbine component preform 10 is disclosed. The as-cast turbine component preform 10 may be used to make various turbine components for any suitable type of industrial turbine engine, particularly various industrial gas turbine and wind turbine engines, and is particularly suited for making turbine components having large sizes and section thicknesses. The as-cast turbine component preform 10 may be a preform for any desired turbine component, and is particularly suited as a preform for a cylindrical or partially cylindrical turbine component, such as a turbine casing preform 30 and turbine nozzle diaphragm preform 50. The turbine component preform 10 includes an as-cast body 12 comprising a partially cylindrical wall section 14. The wall section 14 is referred to as partially cylindrical so as to encompass any axially extending circumferential portion or segment of a cylinder, including semi-cylinder or full cylinder configurations, as well as all manner of circumferential cylindrical segments. The wall section 14 has an inner surface 16 disposed closer to the longitudinal axis 18 of the cylinder and an outer surface 20 disposed away from the axis 18. The wall section 14 includes a circumferentially-extending, near-net shape as-cast feature formed in the wall section 14 on one of the inner surface 16, outer surface 20 or both. Exemplary embodiments include at least a partially cylindrical, as-cast turbine casing preform 30 having at least one integral, as-cast, near-net shape, circumferentially-extending vane slot 32 formed on the inner surface 16 and a partially cylindrical, as-cast turbine nozzle diaphragm preform 50 having an as-cast, protruding, circumferentially-extending seal 52 formed on inner surface 16, outer surface 20 or both, as described herein.

Figure 3:
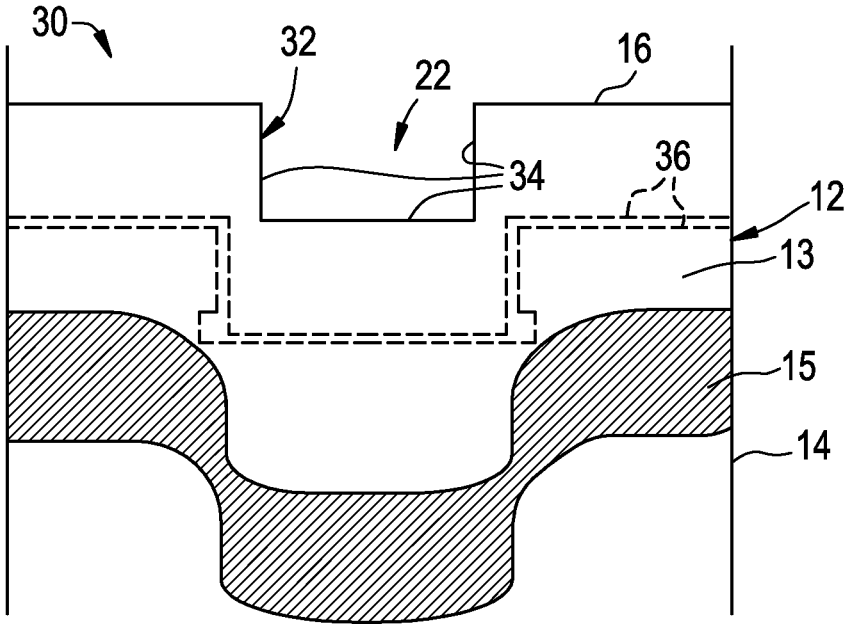
FIG. 3 is as a cross-sectional view of section 3-3 of FIG. 1 that illustrates as-cast and final profiles of an exemplary embodiment of turbine component feature in the form of a near-net shape vane slot as disclosed herein.

As illustrated in FIGS. 1 and 3, in an exemplary embodiment, a turbine casing preform 30 is disclosed. The turbine casing 30 may include any aspect of the turbine casing, including compressor cases, compressor discharge cases and turbine shells. The turbine casing preform 30 includes an as-cast body 12. The as-cast casing body may include a partially cylindrical wall section 14 of a turbine casing preform 30. In the embodiment of FIGS. 1 and 3, a cylindrical (e.g., fully cylindrical) wall section 14 is shown comprising two semi-cylindrical wall sections 14. In other embodiments, the cylindrical wall section 14 may be only a partially cylindrical wall section 14 of a casing preform (not shown). The wall section 14 has an inner surface 16 disposed closer to the longitudinal axis 18 of the cylinder and an outer surface 20 disposed away from the axis 18. The as-cast wall section 14 also includes an as-cast, circumferentially-extending feature 22 in the form of an as-cast, circumferentially-extending vane slot 32 formed in the wall section 14 on the inner surface 16. While it may include as few as one as-cast, circumferentially-extending vane slot 32, it may also include a plurality of as-cast, circumferentially-extending vane slots 32 that are spaced from one another along the longitudinal axis 18 of the casing preform 30.

The vane slot 32 may have any suitable as-cast slot profile 34. In an exemplary embodiment, the circumferentially-extending vane slot 32 has an as-cast slot profile 34 or shape that is substantially the same as a final slot profile 36 or shape, as shown in FIG. 3. For example, if the final profile 36 of the vane slot 32 comprises a rectangular or alternately an inverted T-shape dovetail profile 36, the as-cast profile 34 may also comprise a rectangular or alternately an inverted T-shape dovetail profile 36, i.e., a generally rectangular profile (transverse to the circumferential direction) slot where the bottom portion of the rectangular slot has an increased width, thereby providing a wider channel at the bottom of the slot. The as-cast feature 22 may have an as-cast slot profile 34 that comprises a final profile 36, i.e., that may be used directly without machining, grinding or other finishing operations. It may also have an as-cast slot profile 34 that approximates the final slot profile 36 or shape with sufficient material to provide a material allowance sufficient for finishing operations.

Figure 4:
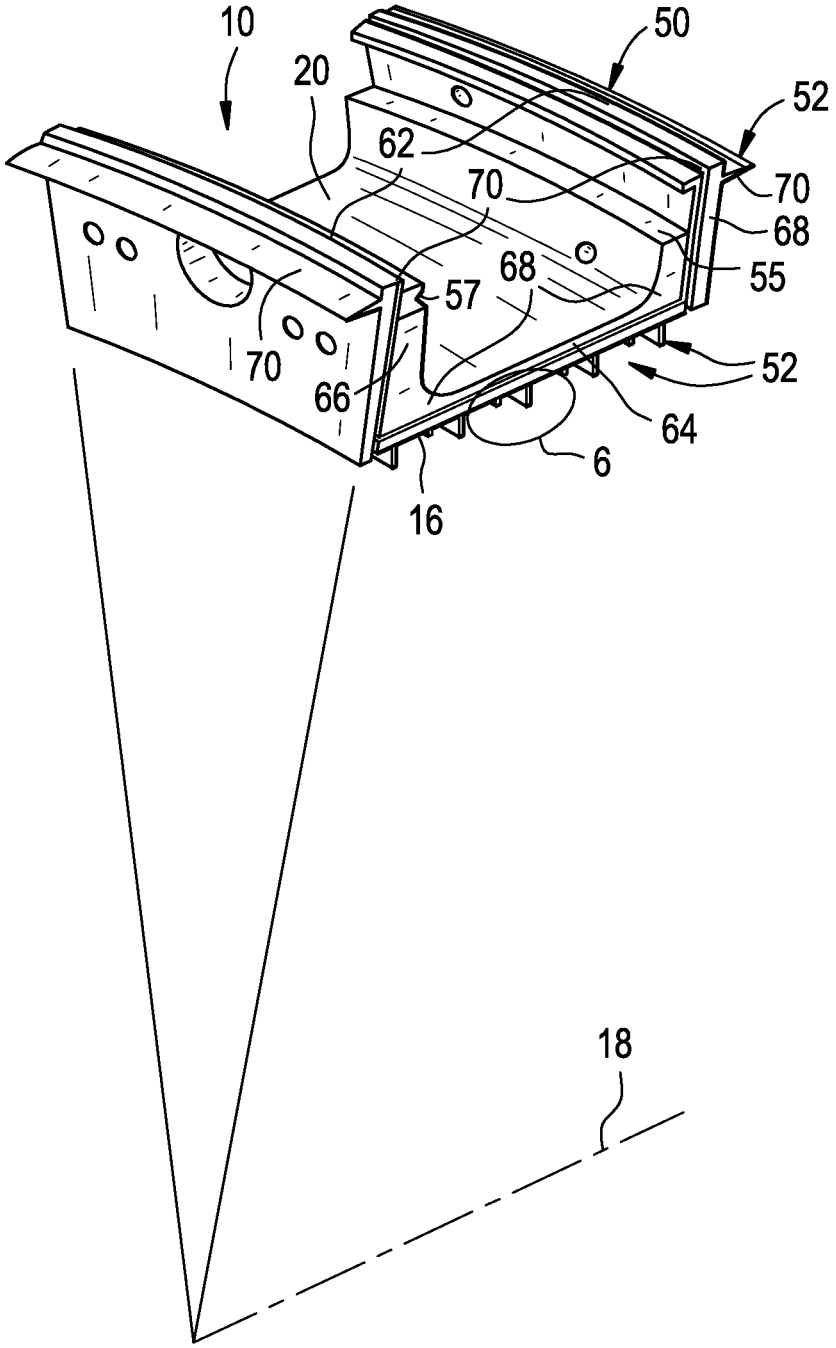
FIG. 4 is a perspective view of another exemplary embodiment of a turbine component preform in the form of a turbine nozzle diaphragm preform as disclosed herein.
Figure 6:
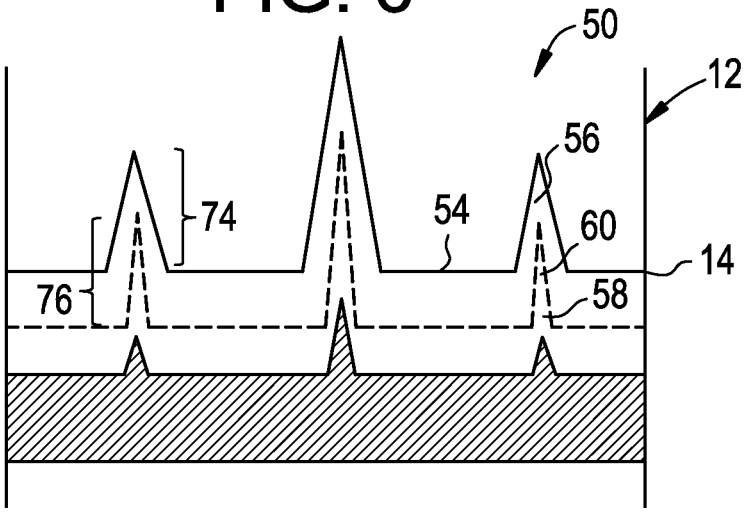
FIG. 6 is as a cross-sectional view of section 6-6 of FIG. 4 that illustrates as-cast and final profiles of an exemplary embodiment of turbine component feature in the form of a near-net shape tooth seals as disclosed herein.

As illustrated in FIGS. 4 and 6, in another exemplary embodiment, a turbine nozzle diaphragm preform 50 is disclosed. The turbine nozzle diaphragm preform 50 includes an as-cast body 12. The as-cast body 12 includes a partially cylindrical wall section 14 of a turbine nozzle diaphragm preform 50. In one embodiment, the partially cylindrical wall section 14 may comprise a semi-cylindrical or fully cylindrical wall section 14. The as-cast wall section 14 also includes an as-cast, circumferentially-extending feature 22 in the form of an as-cast, circumferentially-extending seal member 52 formed in and projecting from the wall section 14 on the inner surface 16, outer surface 20, or both surfaces. While it may include only one as-cast, circumferentially-extending seal member projecting from the wall section 14, the circumferentially-extending seal member 52 may include a plurality of circumferentially-extending seal members 52. In one embodiment as shown in FIG. 6, the projecting seal member 52 comprises a plurality of seal teeth 54 projecting radially inwardly from the inner surface 16 of the as-cast body 12. Other circumferentially-extending features, such as various shoulders 55 and slots 57 formed in or on the inner surface 16, outer surface 20, or both.

The projecting seal member 52 may have any suitable as-cast seal profile 56. In an exemplary embodiment, the circumferentially-extending seal member 52 has an as-cast seal profile 56 or shape that is substantially the same as a final seal profile 58 or shape, as shown in FIG. 6. For example, if the final profile 58 of the seal member 52 comprises a tooth shaped profile 60, the as-cast profile 56 may also comprise a plurality of seal teeth 60 having alternating sizes in a pattern, such as an alternating arrangement of shorter and longer seal teeth 60. The as-cast feature 22 may have an as-cast seal member profile 56 that comprises a final profile 58, i.e., that may be used directly without machining, grinding or other finishing operations. It may also have an as-cast seal member profile 56 that approximates the final seal profile 58 or shape with sufficient material to provide a material allowance sufficient for finishing operations as shown in FIG. 6. In one embodiment, the turbine nozzle diaphragm preform 50 has a partially-cylindrical wall section 14 that has a generally U-shaped profile 62 comprising a base 64 having opposed ends and two legs 66, with each leg 66 extending radially outwardly from one of the opposed ends 68, and a plurality of circumferentially extending seal teeth 60 project radially inwardly from an inner surface 16 of the base 64. The legs 66 may also include an outwardly or an inwardly projecting lip seal 70, or both, on any portion of the leg 66, particularly on an end 72 away from the base 64. The projecting seal member 52 may have any suitable as-cast seal profile 56, including an as-cast seal profile 56 that is substantially the same as the final seal profile 58. In one embodiment, the plurality of circumferentially-extending seal teeth 60 may have an as-cast tooth profile 74 that is substantially the same as a final tooth profile 76. In another embodiment, circumferentially-extending lip seal 70 may also have an as-cast lip seal profile that is substantially the same as a final lip profile, and would be illustrated similarly to that of the tooth seal profiles of FIG. 6.

In the various embodiments, the turbine component preforms 10 disclosed, such as turbine casing preforms 30 or turbine nozzle diaphragm preforms 50, have an as-cast body 12 formed from cast iron, particularly various grades of ductile iron. In one exemplary embodiment, the cast iron has a composition that includes, by weight, about 2% to about 4% Si, about 3.15% to about 3.71% C, and the balance Fe and incidental impurities as shown in FIG. 7, and the microstructure comprises a mixture of ferrite and pearlite as a matrix having a plurality graphite nodules dispersed therein, particularly a plurality of substantially spheroidal graphite nodules disperse therein. In ductile iron, silicon acts as a carbon equivalent constituent element in that it may be substituted in the crystal lattice in place of carbon in a mass ratio of approximately three to one, such that the approximately one third of the silicon by weight constitutes an equivalent weight of carbon. In the composition described above, the cast iron has a carbon equivalent content, by weight, of about 4.38% to about 4.49%, as shown in FIG. 7. For the ferritic/pearlitic compositions, the composition and carbon equivalents may be selected to provide a eutectic composition so as to lower the temperature at which the alloy solidifies, thereby enhancing the flow characteristics of the alloy within the mold while molten and the solidification characteristics once the temperature has dropped below the eutectic reaction isotherm.

In another exemplary embodiment, the cast iron has a composition that includes, by weight, about 1.5% to about 3.0% Si, about 2.71% to about 3.16% C, and the balance Fe and incidental impurities as shown in FIG. 8, and the microstructure comprises a austenite as a matrix having a plurality graphite nodules dispersed therein, particularly a plurality of substantially spheroidal graphite nodules disperse therein. In the composition described above, the cast iron has a carbon equivalent content, by weight, of about 3.66% to about 3.71%, as shown in FIG. 8. For the austenitic compositions, the composition and carbon equivalents may also be selected to provide a eutectic composition so as to lower the temperature at which the alloy solidifies, thereby enhancing the flow characteristics of the alloy within the mold while molten and the solidification characteristics once the temperature has dropped below the eutectic reaction isotherm.

Figure 2:
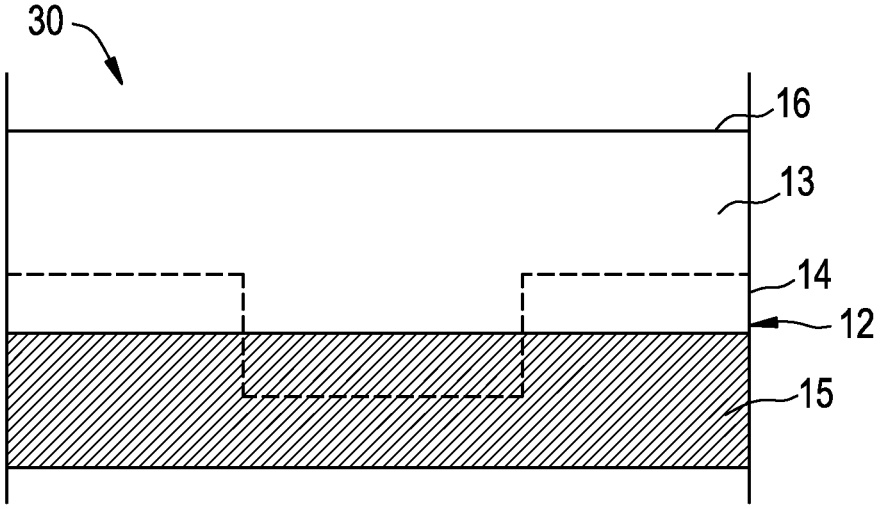
FIG. 2 is as a cross-sectional view illustrating the as-cast and final profiles of a related art turbine component feature casting in the form of a vane slot made by sand casting.
Figure 5:
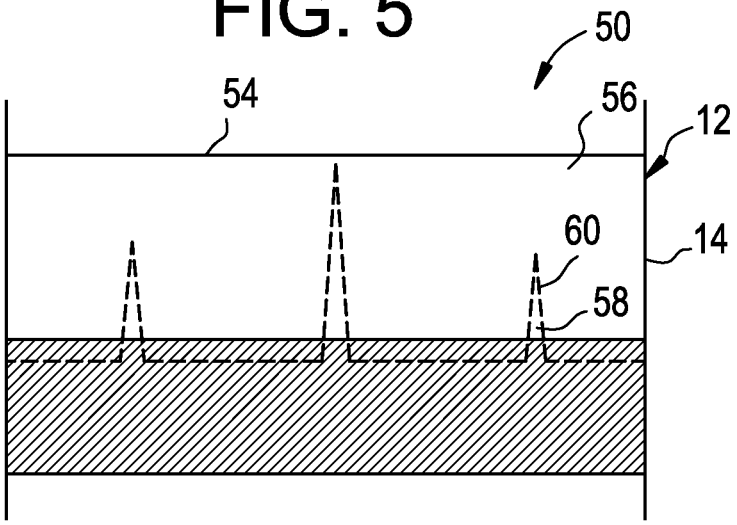
FIG. 5 is as a cross-sectional view illustrating the as-cast and final profiles of a related art turbine component feature casting in the form of tooth seals made by sand casting.

As noted above, the microstructure is that of nodular cast iron having generally spheroidal graphite nodules dispersed in an iron-rich matrix, which may be ferritic or austenitic depending on the composition. In one embodiment, the turbine components disclosed, such as turbine casing preforms 30 or turbine nozzle diaphragm preforms 50, have an as-cast microstructure that is substantially free of defects, including microporosity associated with shrinkage and degenerate forms of graphite, particularly various degraded graphite forms, such as compacted graphite, low nodule count (oversized nodules), exploded graphite, chunky graphite, graphite floatation, nodule alignment, spiky graphite, flake graphite or carbides. This may be seen, for example, by comparing FIGS. 2 and 5 with FIGS. 3 and 6. FIGS. 2 and 5 schematically depict areas proximate an as-cast feature 22 in a cast iron turbine casing (FIG. 2) and nozzle diaphragm (FIG. 5) made by sand casting. FIGS. 3 and 6 schematically depict areas proximate an as-cast feature 22 in a cast iron turbine casing (FIG. 3) and nozzle diaphragm (FIG. 6) made by the lost foam method described herein. In FIGS. 2 and 5, the machining allowances needed to accommodate the sand casting process for the section thicknesses and size of a turbine casing and nozzle diaphragm make definition of an as-cast feature, such as a vane slot (FIG. 2) or tooth seal (FIG. 5), very difficult, such that there is very little or no definition of the feature in the as-cast surface 54 of the as-cast body 12. Therefore, the feature must be formed by machining and removes material from the fine grain layer 13 proximate the surface of the casting to a depth that exposes a layer 15 or subsurface region having a larger grain size due to the slower sub-surface cooling rates, and which may also contain volumetric defects, such as microporosity, and degraded graphite forms. Exposure of this layer exposes defects that may act as crack initiation sites for fatigue processes, particularly when the case/vanes and nozzle diaphragm are installed and the turbine is operating, thereby reducing the operating lifetime of these components.

In contrast, in FIGS. 3 and 6, the machining allowances needed to accommodate the lost foam casting process for the section thicknesses and sizes of turbine casings and nozzle diaphragms allow definition of an as-cast feature, such as a vane slot in a turbine casing, and a tooth seal or lip seal in a nozzle diaphragm, such that the feature may be defined in the as-cast surface of the as-cast body 12 to provide an as-cast vane slot profile 34 or as-cast seal profile 56 as a near-net shape feature, such that the shape of the as-cast vane slot profile 34 or as-cast seal profile 56 is substantially the same a final vane slot profile 36 or final seal profile 58, respectively. In this case, it is not necessary to form the feature almost entirely by machining and remove material from the fine grain layer 13 proximate the surface of the casting to a depth that exposes the layer 15 having a larger grain size and containing volumetric defects, such as microporosity, and degraded graphite forms. This tends to reduce defects that may act as crack initiation sites for fatigue processes and improve the operating lifetimes of the turbine casings 30 and nozzle diaphragms 50 disclosed herein.

In an exemplary embodiment, the as-cast turbine component preform 10 has a fine grain as-cast microstructure with an average nodule count of about 100/mm$^2$ or smaller, and more particularly has the fine grain microstructure proximate the as-cast feature 22, such as the vane slot 32 or seal member 52. The fine grain microstructure proximate the as-cast feature 22 extends to a depth greater than the machining allowance, such that the fine grain microstructure remains even after the machining allowance has been removed. This provides the desirable fine grain microstructure proximate the feature 22, thereby improving the fatigue resistance of the finished turbine casing.

In contrast to cast iron turbine components that are made by sand casting, and due to their large section thicknesses require large machining allowances and prevent the incorporation of features 22, such as vane slots 32 having as-cast slot profiles and seal members 52 having as-cast tooth profiles 56, the turbine components described herein, such as the turbine casing preform 30 and nozzle diaphragm preform 50, are cast to a near net shape and are thus also able to incorporate near-net features 22, such as near-net shape vane slot 32 or near-net shape seal member 52. The difference between the sand cast turbine component preforms 10 and the turbine component preforms 10 described herein may also be understood by comparing the weight of the final component to the weight of the as-cast component preform 10 as a ratio of these quantities. The as-cast body of the final component has a weight and the turbine component preform 10 has a weight, and the ratio of the weight of the final component to the as-cast body weight is about 0.7 or more, and more particularly about 0.8 or more, and even more particularly about 0.9 or more.

The near-net shape turbine component preforms 10 may be made by a "lost foam process" in which a refractory coated pyrolyzable pattern is disposed in a casting flask, embedded in a gas-permeable refractory packing and appropriately gated for the introduction of the molten cast iron. The introduction of the molten metal pyrolyzes the pattern material so that the molten metal assumes the shape of the refractory pattern coating. The lost foam process uses patterns that may be machined made from expanded polystyrene or other materials, such as poly(methyl methacrylate) (PMMA) that can be pyrolyzed by the molten metal and produce less gases during removal than expanded polystyrene. The patterns are coated with a gas permeable refractory material that is porous to provide a path for the gases generated by the thermal decomposition of the pattern material to be removed as the molten metal is poured into the pattern. Castings of turbine component preforms 10 made using this process may be cast to a near-net shape as described herein, thereby greatly reducing or eliminating the machining allowances typical of conventional sand casting geometries. This method may be used to make ductile iron casting preforms of various large turbine components used in turbine engine applications, such as turbine casing preforms and turbine nozzle diaphragm preforms, including those having a mass of about 5 US tons or more. Sand cast turbine components usually have inferior structural integrity, including microstructural integrity, due to the large section thicknesses, slow cooling and solidification characteristics due to the substantial machining allowances added to these components. The large section thicknesses and machining allowances needed also have also limited the manufacture of castings with various cast-in features, particularly near-net shape features. For this reason, sand casting of cast iron has not been widely used to make turbine component preforms.

Near net shape patterns may be CNC-machined from blocks of polystyrene or PMMA. Depending on the size and complexity of castings, these replicas can consist of multiple layers of polystyrene foam glued together. Prior to coating the pattern assemblies with refractory slurry, they are washed with water mixed with a small amount of detergent, which helps wet the surface and prevent air pockets from forming when coated with refractory slurry. This slurry is generally made of fine zircon sand along with a binder of colloidal silica, hydrolyzed ethyl silicate, potassium or sodium silicate and needs to be strong enough to support the internal pressure and erosive forces exerted by the flow of molten metal and permeable enough to allow gas to escape. Then patterns with slurry coating get dried in an oven or air. These pattern assemblies are then placed in a mold cask where loose sand or resin bonded sand is molded and packed around them. The molds are typically incorporated with vents through which gas generated from the reaction can escape from them, not interfering with mold filling. Once the pattern with the refractory coating has been placed into the mold cask and the mold material, such as loose sand or resin bonded sand has been placed around the pattern, the cast iron is poured into the foam pattern thereby pyrolizing the foam and forming the turbine component preform 10 upon solidification of the cast iron.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine casing preform, comprising:

an as-cast body comprising a partially cylindrical wall section of a turbine casing, the wall section having an inner surface and an outer surface, the as-cast body comprising a nodular cast iron; and an as-cast vane slot formed in the wall section on the inner surface, the inner surface proximate the as-cast vane slot comprising a fine grain size as-cast microstructure having an average graphite nodule count of 100/mm$^2$ or less, the as-cast vane slot having an as-cast slot profile that is configured for removal of the nodular cast iron to a depth sufficient to form a final vane slot having a final slot profile and a microstructure proximate the final vane slot that is substantially the same as the as-cast microstructure.

2. The turbine casing preform of claim 1, wherein the as cast slot profile is substantially the same as the final slot profile.

3. The turbine casing preform of claim 1, wherein the partially cylindrical wall section is a semi-cylindrical wall section.

4. The turbine casing preform of claim 1, wherein the partially cylindrical wall section is a cylindrical wall section.

5. The turbine casing preform of claim 1, wherein the vane slot comprises a plurality of vane slots that are spaced from one another along a longitudinal axis of the preform.

6. The turbine casing preform of claim 1, wherein each as cast slot profile is substantially the same as the corresponding Flail final slot profile.

7. The turbine casing preform of claim 1, wherein the as-cast body comprises a cast iron.

8. The turbine casing preform of claim 7, wherein the cast iron comprises, by weight, about 2% to about 4% Si, about 3.15% to about 3.71% C, and the balance Fe and incidental impurities.

9. The turbine casing preform of claim 8, wherein the cast iron has a carbon equivalent content, by weight, of about 4.38% to about 4.49%.

10. The turbine casing preform of claim 7, wherein the cast iron has an as-cast microstructure that is substantially free of degenerate graphite.

11. The turbine casing preform of claim 1, wherein the as cast body has a weight and a final body formed from the as-cast body has a weight, and the ratio of the weight of the as-cast body to the weight of the final body is about 0.7 or more.

12. The turbine casing preform of claim 11, wherein the ratio of the weight of the as-cast body to the weight of the final body is about 0.9 or more.

13. A turbine nozzle diaphragm preform, comprising:

an as-cast body comprising a partially-cylindrical wall section of a turbine nozzle diaphragm having an inner surface and an outer surface, the as-cast body comprising a nodular cast iron; and an as-cast, seal member projecting from one of the outer surface or inner surface, the inner surface proximate the as-cast seal member comprising a fine grain size as-cast microstructure having an average graphite nodule count of 100/mm$^2$ or less, the as-cast seal member having an as-cast seal member profile that is configured for removal of the nodular cast iron to a depth sufficient to form a final seal member having a final seal member profile and a microstructure proximate the final seal member that is substantially the same as the as-cast microstructure.

14. The turbine nozzle diaphragm preform of claim 13, wherein the seal member comprises a plurality of seal teeth projecting radially inwardly from the inner surface of the as-cast body.

15. The turbine nozzle diaphragm preform of claim 14, wherein the partially-cylindrical wall section has a generally U-shaped profile comprising a base having opposed ends and two legs, each leg extending radially outwardly from one of the opposed ends, the plurality of seal teeth project radially inwardly from an inner surface of the base.

16. The turbine nozzle diaphragm preform of claim 15, wherein one of the legs has an outwardly projecting lip seal on an end away from the base.

17. The turbine nozzle diaphragm preform of claim 16, wherein the outwardly extending lip seal has an as-cast lip seal profile that is substantially the same as a final lip seal profile.

18. The turbine nozzle diaphragm preform of claim 14, wherein the plurality of seal teeth have an as-cast tooth profile that is substantially the same as a final tooth profile.

19. The turbine nozzle diaphragm preform of claim 13, wherein the as-cast body comprises a cast iron having a composition comprising, by weight, about 1.5% to about 3% Si, about 2.71% to about 3.16% C and the balance Fe and incidental impurities, and having a microstructure comprising austenite as a matrix and a plurality of graphite nodules dispersed in the matrix.

20. The turbine nozzle diaphragm preform of claim 13, wherein the as-cast body comprises a cast iron having a composition comprising, by weight, about 2% to about 4% Si, about 3.15% to about 3.71% C and the balance Fe and incidental impurities, and having a microstructure comprising a mixture of ferrite and pearlite as a matrix and a plurality of graphite nodules dispersed in the matrix.

* * * * *